US012157866B2

(12) United States Patent
Rock et al.

(10) Patent No.: US 12,157,866 B2
(45) Date of Patent: Dec. 3, 2024

(54) DRIVELINE AND TRANSMISSION FLUIDS FOR LOW SPEED WEAR AND SCUFFING

(71) Applicant: Afton Chemical Corporation, Richmond, VA (US)

(72) Inventors: Bryan Rock, North Chesterfield, VA (US); Carey Lehner, Midlothian, VA (US); Carmen Betts, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/063,791

(22) Filed: Dec. 9, 2022

(65) Prior Publication Data

US 2024/0199970 A1 Jun. 20, 2024

(51) Int. Cl.

| | |
|---|---|
| ***C10M 137/06*** | (2006.01) |
| ***C10M 129/08*** | (2006.01) |
| ***C10M 133/44*** | (2006.01) |
| ***C10M 135/10*** | (2006.01) |

(52) U.S. Cl.

CPC ..... *C10M 137/06* (2013.01); *C10M 129/08* (2013.01); *C10M 133/44* (2013.01); *C10M 135/10* (2013.01); *C10M 2207/022* (2013.01); *C10M 2215/223* (2013.01); *C10M 2219/044* (2013.01); *C10M 2223/045* (2013.01)

(58) Field of Classification Search

CPC ..... C10M 137/06; C10M 129/08; C10M 133/44; C10M 135/10; C10M 2207/022; C10M 2215/223; C10M 2219/044; C10M 2223/045

See application file for complete search history.

(56) References Cited

U.S. PATENT DOCUMENTS

| | | | |
|---|---|---|---|
| 3,178,663 | A | 4/1965 | Kahn |
| 3,185,647 | A | 5/1965 | Anderson et al. |
| 3,189,544 | A | 6/1965 | Ratner et al. |
| 3,256,185 | A | 6/1966 | Le Suer |
| 3,278,550 | A | 10/1966 | Norman et al. |
| 3,312,619 | A | 4/1967 | Vineyard |
| 3,366,569 | A | 1/1968 | Norman et al. |
| 3,390,086 | A | 6/1968 | O'Halloran |
| 3,403,102 | A | 9/1968 | Le Suer |
| 3,458,530 | A | 7/1969 | Siegel et al. |
| 3,470,098 | A | 9/1969 | O'Halloran |
| 3,502,677 | A | 3/1970 | Le Sner |
| 3,519,564 | A | 7/1970 | Vogel |
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,708,522 | A | 1/1973 | Le Suer |
| 3,749,695 | A | 7/1973 | de Vries |
| 3,859,318 | A | 1/1975 | Lesuer |
| 3,865,740 | A | 2/1975 | Goldschmidt |
| 3,865,813 | A | 2/1975 | Gergel |
| 3,954,639 | A | 5/1976 | Liston |
| 4,152,499 | A | 5/1979 | Boerzel et al. |
| 4,234,435 | A | 11/1980 | Meinhardt et al. |
| 4,259,194 | A | 3/1981 | deVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | deVries et al. |
| 4,272,387 | A | 6/1981 | King et al. |
| 4,283,295 | A | 8/1981 | deVries et al. |
| 4,285,822 | A | 8/1981 | deVries et al. |
| 4,379,064 | A | 4/1983 | Cengel et al. |
| 4,482,464 | A | 11/1984 | Karol et al. |
| 4,521,318 | A | 6/1985 | Karol |
| 4,554,086 | A | 11/1985 | Karol et al. |
| 4,579,675 | A | 4/1986 | Sawicki et al. |
| 4,612,132 | A | 9/1986 | Wollenberg et al. |
| 4,614,522 | A | 9/1986 | Buckley |
| 4,614,603 | A | 9/1986 | Wollenberg |
| 4,617,137 | A | 10/1986 | Plavac |
| 4,617,138 | A | 10/1986 | Wollenberg |
| 4,636,322 | A | 1/1987 | Nalesnik |
| 4,645,515 | A | 2/1987 | Wollenberg |
| 4,646,860 | A | 3/1987 | Owens et al. |
| 4,647,390 | A | 3/1987 | Buckley, III et al. |
| 4,648,886 | A | 3/1987 | Buckley, III et al. |

(Continued)

FOREIGN PATENT DOCUMENTS

| | | | | |
|---|---|---|---|---|
| EP | 2789679 | A1 | 10/2014 | |
| GB | 1065595 | A | 4/1967 | |
| GB | 2140811 | A | 12/1984 | |
| GB | 2440811 | A | 2/2008 | |
| WO | 9406897 | A1 | 3/1994 | |
| WO | 2008124386 | A2 | 10/2008 | |
| WO | WO-2013070347 | A1 * | 5/2013 | ..... C10M 129/08 |

OTHER PUBLICATIONS

Caterpillar Inc, "Tansmission and Drive Train Fluid Requirements." Specification T0-4 (Jun. 23, 2005): 1-44.

European Search Report for 23211153.4, dated May 16, 2024.

*Primary Examiner* — Vishal V Vasith

(74) *Attorney, Agent, or Firm* — Honigman LLP

(57) ABSTRACT

This disclosure relates to lubricants with certain amounts of calcium and zinc that tend to perform well in the low-speed FZG scuffing tests of CEC L-07 (FZG A/8.3/90) and further include certain amounts of low molecular weight diol and/or triol compounds to achieve good gear wear performance in FZG wear tests. The lubricants herein are suitable for use as industrial gear oils for transmission fluids (i.e., manual, automatic, or dual-clutch transmissions), gear fluids, axle fluids, differential fluids, and/or lubricating fluids for other gear-type applications configured for heavy-duty applications.

20 Claims, No Drawings

(56) References Cited

U.S. PATENT DOCUMENTS

| | | | |
|---|---|---|---|
| 4,648,980 | A | 3/1987 | Erdman |
| 4,652,387 | A | 3/1987 | Andress, Jr. et al. |
| 4,663,062 | A | 5/1987 | Wollenberg |
| 4,663,064 | A | 5/1987 | Nalesnik et al. |
| 4,666,459 | A | 5/1987 | Wollenberg |
| 4,666,460 | A | 5/1987 | Wollenberg |
| 4,668,246 | A | 5/1987 | Wollenberg |
| 4,670,170 | A | 6/1987 | Wollenberg |
| 4,699,724 | A | 10/1987 | Nalesnik et al. |
| 4,713,189 | A | 12/1987 | Nalesnik et al. |
| 4,713,191 | A | 12/1987 | Nalesnik |
| 4,857,214 | A | 8/1989 | Papay et al. |
| 4,943,672 | A | 7/1990 | Hamner et al. |
| 4,948,386 | A | 8/1990 | Sung et al. |
| 4,963,275 | A | 10/1990 | Gutierrez et al. |
| 4,963,278 | A | 10/1990 | Blain et al. |
| 4,971,598 | A | 11/1990 | Andress et al. |
| 4,971,711 | A | 11/1990 | Lundberg et al. |
| 4,973,412 | A | 11/1990 | Migdal et al. |
| 4,981,492 | A | 1/1991 | Blain et al. |
| 5,026,495 | A | 6/1991 | Emert et al. |
| 5,030,249 | A | 7/1991 | Herbstman et al. |
| 5,039,307 | A | 8/1991 | Herbstman et al. |
| 5,075,383 | A | 12/1991 | Migdal et al. |
| 5,241,003 | A | 8/1993 | Degonia et al. |
| 5,334,321 | A | 8/1994 | Harrison et al. |
| 5,344,579 | A | 9/1994 | Ohtani et al. |
| 5,650,381 | A | 7/1997 | Gatto et al. |
| 5,739,355 | A | 4/1998 | Gateau et al. |
| 5,882,505 | A | 3/1999 | Wittenbrink et al. |
| 5,888,945 | A | 3/1999 | Stiefel et al. |
| 6,010,987 | A | 1/2000 | Stiefel et al. |
| 6,013,171 | A | 1/2000 | Cook et al. |
| 6,080,301 | A | 6/2000 | Berlowitz et al. |
| 6,096,940 | A | 8/2000 | Wittenbrink et al. |
| 6,103,099 | A | 8/2000 | Wittenbrink et al. |
| 6,107,257 | A | 8/2000 | Valcho et al. |
| 6,165,949 | A | 12/2000 | Berlowitz et al. |
| 6,180,575 | B1 | 1/2001 | Nipe |
| RE37,363 | E | 9/2001 | Gatto et al. |
| 6,723,685 | B2 | 4/2004 | Hartley et al. |
| RE38,929 | E | 1/2006 | Gatto et al. |
| 7,214,649 | B2 | 5/2007 | Loper et al. |
| 7,253,231 | B2 | 8/2007 | Devlin et al. |
| 7,368,596 | B2 | 5/2008 | Thomson et al. |
| RE40,595 | E | 12/2008 | Gatto et al. |
| 7,485,603 | B2 | 2/2009 | Bera et al. |
| 7,645,726 | B2 | 1/2010 | Loper |
| 7,732,390 | B2 | 6/2010 | Kadkhodayan et al. |
| 7,786,057 | B2 | 8/2010 | Bera et al. |
| 7,897,696 | B2 | 3/2011 | Huang et al. |
| 8,048,831 | B2 | 11/2011 | Loper |
| 8,076,275 | B2 | 12/2011 | Ruhe, Jr. et al. |
| 8,703,679 | B2 | 4/2014 | Li et al. |
| 10,023,824 | B2 | 7/2018 | Bender |
| 2006/0173135 | A1 | 8/2006 | Devlin et al. |
| 2012/0101017 | A1 | 4/2012 | Duggal |
| 2013/0157908 | A1* | 6/2013 | Li ..... C10M 163/00 508/501 |
| 2019/0002789 | A1 | 1/2019 | Boffa et al. |
| 2019/0264124 | A1 | 8/2019 | Narita |
| 2019/0270947 | A1* | 9/2019 | Hogendoorn ..... C10M 167/00 |
| 2019/0390134 | A1 | 12/2019 | Chommeloux et al. |
| 2020/0318025 | A1 | 10/2020 | Sampler et al. |
| 2020/0354647 | A1 | 11/2020 | Schwaebisch et al. |
| 2020/0377817 | A1* | 12/2020 | Sampler ..... C10M 143/18 |

* cited by examiner

DRIVELINE AND TRANSMISSION FLUIDS FOR LOW SPEED WEAR AND SCUFFING

TECHNICAL FIELD

The present disclosure relates to driveline and/or transmission fluids containing low molecular weight diol and/or triol compounds effective to achieve low speed wear and scuffing resistance.

BACKGROUND

Driveline hardware like gears, axles, and the like commonly require lubricants that provide antiwear and/or extreme pressure protection. In practice, gears and axles can be operated at full-load capacity and/or with frequent stop-and-go operations putting additional stress and strain on the hardware. Thus, lubricants for heavy duty gear, axle, and transmission applications need additive chemistry to reliably protect gears and axles under both the full-load and the stop-and-go operating conditions. Typically, lubricants for such heavy-duty applications require, for example, the fluid to meet one or more performance characteristics of extreme pressure, antiwear, friction, and/or copper corrosion to suggest but a few of the common requirements of driveline hardware fluids. A number of additives may be included in the lubricant to achieve such performance.

More specifically, Caterpillar Corporation introduced a set of transmission and drivetrain fluid requirements, designated as the so-called Caterpillar TO-4 specifications, for use in Caterpillar's heavy vehicle machinery and equipment. Lubricant compositions which meet the requirements of the Caterpillar TO-4 specification are considered generally suitable for heavy duty and/or off-road driveline or transmission applications. All Caterpillar TO-4 lubricant compositions must comply with a number of performance standards including wear, viscometric, and friction conditions as set out in the Caterpillar TO-4 specification. Many of the additives used in driveline and transmission lubricants tend to be multifunctional and, in some circumstances, there may be conflicts between properties, such as providing low speed wear performance to spur gears and/or maintenance of acceptable friction and scuffing characteristics at the same time.

In particular, Caterpillar TO-4 compliant lubricants have to fulfill specific requirements for, among other features, low-speed wear pursuant to ASTM D4998 as well as strong scuffing performance pursuant to CEC L-07 (FZG A/8.3/90). Conventional crankcase lubricant compositions usually do not fulfill the requirements for such wear performance or scuffing resistance according to the Caterpillar TO-4 specification because the additive mixtures tend to fail one or more of the wear, friction, and/or scuffing tests. For instance, use of dispersants and/or molybdenum-containing friction modifiers is typically avoided in lubricants destined for off-road driveline or transmission applications since such additives may, for instance, lower the static friction to a level that no longer qualifies under the Caterpillar TO-4 specification. In other instances, heavy duty lubricants having adequate levels of metal, such as zinc and calcium for example, from an antiwear additive and/or detergent may show strong low speed gear wear performance, but then provide less than desirable load stage scuffing resistance.

SUMMARY

In one approach or embodiment, an off-road lubricant composition, such as a TO-4 lubricant, is described herein and includes one or more base oils of lubricating viscosity; about 200 ppm to about 2,000 ppm of zinc provided by one or more zinc dialkyl dithiophosphate compounds; one or more metal-containing detergents providing about 1,000 to about 5,000 ppm of metal selected from calcium, magnesium and/or sodium and provided from one or more C6 to C30 branched metal salts of phenates, sulfonates, calixarates, salixarates, salicylates, carboxylic acids, or combinations thereof; no more than about 300 ppm of nitrogen provided from one or more nitrogen-containing ashless dispersants; and about 0.01 to about 3.5 weight percent of a low molecular weight diol or triol compound, such as a C2 to C3 diol or triol compound or mixture thereof.

In other approaches or embodiments, the off-road lubricant composition described in the previous paragraph may including optional features or embodiments in any combination. These optional features or embodiments may include one or more of the following: wherein the C2 to C3 diol or triol compound is trihydroxypropane, wherein the C2 to C3 diol or triol compound, and preferably the trihydroxypropane, is a non-esterified compound; and/or wherein the off-road lubricant composition is substantially free of glycerol monooleate (GMO); and/or wherein the off-road lubricant composition includes about 0.01 to about 2 weight percent of the C2 to C3 diol or triol compound or mixture thereof and, preferably 0.01 to about 2 weight percent of trihydroxypropane; and/or wherein the one or more metal containing detergents include an overbased metal salt of an branched polyolefin substituted phenate, sulfonate, and/or salicylate detergent; and/or wherein the branched polyolefin is derived from a branched alkene having at least 3, carbon atoms or at least 4 carbon atoms and wherein the branched polyolefin has a number average molecular weight of about 100 to about 800; and/or wherein the branched polyolefin is derived from an isomerized normal alpha olefin having about 6 to about 30 carbons and an isomerization level of about 0.1 to about 0.4; and/or wherein the overbased metal salt of a branched polyolefin substituted phenate, sulfonate, and/or salicylate detergent has a total base number (TBN) of at least about 250 mg KOH/g on an oil-free basis as measured pursuant to ASTM D2896; and/or wherein the one or more overbased detergents is a branched calcium sulfonate; and/or wherein the off-road lubricant composition satisfies the requirements of Caterpillar TO-4 lubricants including at least low speed wear and scuffing tests with no more than 100 mg of wear, preferably no more than 50 mg of wear as measured pursuant to ASTM D4998 and a passing load stage of 9 or higher, 10 or higher, 11 or higher, or 12 pursuant to CEC L-07 (FZG A/8.3/90); and/or wherein the nitrogen-containing ashless dispersant is a succinimide dispersant.

In other approaches or embodiments, the disclosure herein provides for a method of providing low speed wear and scuffing protection to gears, bearings, and/or clutches according to Caterpillar TO-4 requirements as measured pursuant to ASTM D4998 and CEC L-07 (FZG A/8.3/90). In some aspects, the method includes lubricating the gears, bearings, and/or clutches with a lubricating composition and wherein the lubricating composition includes one or more base oils of lubricating viscosity; about 200 ppm to about 2,000 ppm of zinc provided by a zinc dialkyl dithiophosphate compound; one or more metal-containing detergents providing about 1,000 to about 5,000 ppm of metal selected from calcium, magnesium and/or sodium and provided from one or more C6 to C30 branched metal salts of phenates, sulfonates, calixarates, salixarates, salicylates, carboxylic acids, or combinations thereof; no more than about 300 ppm of nitrogen provided from one or more nitrogen-containing ashless dispersants; and about 0.01 to about 3.5 weight percent of a low molecular weight diol or triol compound and preferably a C2 to C3 diol or triol compound or mixture thereof.

In other approaches or embodiments, the method described in the previous paragraph may be combined with optional features, steps, and/or embodiments in any combination. These option features, steps, or embodiments include one or more of the following: wherein the C2 to C3 diol or triol compound is trihydroxypropane; and/or wherein the C2 to C3 diol or triol compound and preferably the trihydroxypropane is non-esterified; and/or wherein the lubricating composition includes about 0.01 to about 2 weight percent of the C2 to C3 diol or triol compound or mixture thereof; and/or wherein the C2 to C3 diol or triol compound is trihydroxypropane; and/or wherein the one or more metal containing detergents include an overbased metal salt of an branched polyolefin substituted phenate, sulfonate, and/or salicylate detergent; and/or wherein the branched polyolefin is derived from a branched alkene having at least 4 carbon atoms and wherein the branched polyolefin has a number average molecular weight of about 100 to about 800; and/or wherein the branched polyolefin is derived from an isomerized normal alpha olefin having about 4 to about 100 carbons and an isomerization level of about 0.1 to about 0.4; and/or wherein the overbased metal salt of a branched polyolefin substituted phenate, sulfonate, and/or salicylate detergent has a total base number (TBN) of at least about 250 mg KOH/g on an oil-free basis as measured pursuant to ASTM D2896; and/or wherein the one or more overbased detergents is a branched calcium sulfonate; and/or wherein the one or more one or more metal containing detergents includes one or more overbased metal-containing detergents having a total base number (TBN) of at least about 250 mg KOH/g on an oil-free basis as measured pursuant to ASTM D2896; and/or wherein the one or more overbased detergent is a branched calcium sulfonate; and/or wherein the lubricating composition exhibits no more than 100 mg of wear, preferably no more than 50 mg of wear as measured pursuant to ASTM D4998 and a passing load stage of 9 or higher, 10 or higher, 11 or higher, or 12 pursuant to CEC L-07 (FZG A/8.3/90); and/or wherein the nitrogen-containing ashless dispersant is a succinimide dispersant.

In yet other approaches or embodiments, the use of a lubricating composition of any embodiment of this summary is described or disclosed herein for achieving no more than 100 mg of wear, preferably no more than 50 mg of wear, as measured pursuant to ASTM D4998 and a passing load stage of 9 or higher, 10 or higher, 11 or higher, or 12 as measured pursuant to CEC L-07 (FZG A/8.3/90).

Other embodiments of the present disclosure will be apparent to those skilled in the art from consideration of the specification and practice of the invention disclosed herein. The following definitions of terms are provided in order to clarify the meanings of certain terms as used herein.

The terms "gear oil," "gear fluid," "gear lubricant," "base gear lubricant," "lubricating oil," "lubricant composition," "lubricating composition," "lubricant" and "lubricating fluid" refer to a finished lubrication product comprising a major amount of a base oil plus a minor amount of an additive composition as discussed herein. Such gear fluids are for use in extreme pressure situations such as for transmissions and gear drive components having metal-on-metal contact situations, for instance, in a transmission (manual or automatic) and/or a gear differential. Such gear fluids are preferably Caterpillar TO-4 certified gear fluids.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %" or "weight percent", unless expressly stated otherwise, means the percentage the recited component represents to the weight of the entire composition. All percent numbers herein, unless specified otherwise, is weight percent.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, in hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mn of about 180 to about 18,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J.

Kirkland and D. D. Bly, "Modern Size Exclusion Liquid Chromatography", John Wiley and Sons, New York, 1979, also incorporated herein by reference.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

Lubricants configured for drivelines, gear, or axles suitable for TO-4 applications require effective performance in, among other criteria, FZG gear wear and scuffing tests. The FZG test rig is configured to evaluate the extent to which gear lubricants help minimize or prevent wear or scuffing on tooth faces at the lubricant gap of intermeshing gears. Generally, any wear or scuffing occurs locally where the gears are in mesh contact and depends on, for example, the load, peripheral speed, oil sump temperatures, and/or additive selections of the lubricant. At the contact points of the gears, the surfaces may briefly contact and then separate as the gears rotate, which can lead to wear and/or scuffing in some instances. The wear and scuffing load capability of a lubricant generally depends on the additive selection and ability of the lubricant to form a protectant film.

As shown by the Examples herein, TO-4 lubricants with certain amounts of calcium and zinc tend to perform well in the low-speed FZG scuffing tests of CEC L-07 (FZG A/8.3/90), but then tend to provide weak performance in the low-speed FZG gear wear tests of ATSM D4998 with too much gear wear. Discovered herein is that certain amounts of low molecular weight diol and/or triol compounds may be added to the TO-4 lubricant to surprisingly achieve strong performance in both performance tests at the same time. The lubricants herein are suitable for use as industrial gear oils for transmission fluids (i.e., manual, automatic, or dual-clutch transmissions), gear fluids, axle fluids, differential fluids, and/or lubricating fluids for other gear-type applications configured for heavy-duty or TO-4 based applications.

In one aspect of the present disclosure, a heavy-duty and/or off-road lubricant having TO-4 certifications including select amounts of zinc, calcium, and low molecular weight diol or triol compounds in amounts effective to achieve passing performance in both FZG scuffing and gear wear tests. In approaches, the TO-4 lubricant includes one or more base oils of lubricating viscosity; at least about 200 ppm of zinc provided by a zinc dialkyl dithiophosphate compound; one or more metal-containing detergents providing about 1,000 to about 5,000 ppm of metal selected from calcium, magnesium, and/or sodium and provided from one or more C6 to C30 branched metal salts of phenates, suflonates, calixarates, salixarates, salicylates, carboxylic acids, or combinations thereof; no more than about 300 ppm of nitrogen provided from one or more nitrogen-containing ashless detergents; and about 0.01 to about 3.5 weight percent of low molecular weight diol or triol compounds or mixtures thereof.

Diol and/or Triol Compounds

In some embodiments or approaches, the low molecular weight diol or triol compounds are C2 to C3 diol or triol compound, and more preferably, the compound is trihydroxypropane, and most preferably the trihydroxypropane is non-esterified and/or, in some approaches, may include in-situ formed salts of non-esterified trihydroxypropane. For instance, suitable diol and triol compounds may include propylene glycol, ethylene glycol, or propylene triol (i.e., glycerol). In some instances, the lubricants herein are substantially free of esterified diols or triols, such as being substantially free of glycerol monooleate (GMO) and, in such context, the lubricants have no more than 0.1 weight percent of the GMO, no more than 0.05 weight percent of GMO, or preferably none.

As also shown in the Examples, if the TO-4 lubricant includes too much of the C2 to C3 diol or triol compound, then the lubricant may achieve low gear wear, but then fails scuffing performance with too low of a load stage rating. Thus, the lubricants herein preferably includes about 0.01 to about 3.5 weight percent of the C2 to C3 diol or triol compound, and more preferably about 0.01 to about 2 weight percent, or about 0.02 to about 2 weight percent, or about 0.03 to about 2 weight percent of the C2 or C3 diol or triol compound. Preferably, the lubricants herein include 0.01 to about 3.5 weight percent of trihydroxypropane, and more preferably about 0.01 to about 2 weight percent, or about 0.02 to about 2 weight percent, or about 0.03 to about 2 weight percent of trihydroxypropane.

Zinc Dialkyl Dithiophosphate Compound

The TO-4 lubricants herein also preferably include an amount of one or more zinc dialkyl dithiophosphate (ZDDP) compounds. The one or more ZDDP compounds can improve friction and wear properties of the TO-4 fluid compositions and are compatible with the low molecular diol or triol compounds.

The one or more ZDDP compounds can be present in the transmission fluid composition in amounts of from about 0.01 weight percent to about 15 weight percent or about 0.01 weight percent to about 10 weight percent, or about 0.05 weight percent to about 5 weight percent, or about 0.1 weight percent to about 3 weight percent, or about 1 to about 2 weight percent based on the total weight of the transmission fluid composition. In other approaches, the ZDDP compounds are provided in an amount to provide at least about 200 ppm of zinc, and in other approaches, about 200 ppm zinc to about 2,000 ppm of zinc, or about 500 ppm zinc to about 1,800 ppm of zinc, about 500 ppm zinc to about 1,500 ppm zinc, about 600 ppm to about 1,200 ppm, or about 800 ppm zinc to about 1,000 ppm zinc.

In embodiments, the one or more ZDDP compounds can comprise ZDDP compounds derived from primary alkyl alcohols, secondary alkyl alcohols, or a combination of primary and secondary alkyl alcohols. The primary alkyl alcohols and secondary alkyl alcohols used to prepare the one or more ZDDP compounds may have an alkyl group including 1 to 20 carbon atoms, or from about 1 to about 18 carbon atoms, or from about 1 to about 16 carbon atoms, or about 2 to about 12 carbon atoms, or about 3 to about 10 carbon atoms. Preferably, the primary alkyl alcohols have branching at the beta carbon relative to the hydroxyl group. Suitable examples of primary and secondary alkyl alcohols for use in preparing the one or more ZDDP compounds include n-propyl alcohol, isopropyl alcohol, n-butyl alcohol, 2-butanol, isobutyl alcohol, n-pentyl alcohol, amyl alcohol, hexanol, methyl isobutyl carbinol, isohexanol, n-heptanol, isoheptanol, octanol, nonanol, decanol, undecanol, dodecanol, tridecanol, tetradecanol, pentadecanol, hexadecanol, heptadecanol, octadecanol, nonadecanol, eicosanol, 2-ethylhexanol, or mixtures thereof.

In some embodiments, the molar ratio of primary alkyl alcohol to secondary alkyl alcohol used to make the one or more ZDDP compounds in the transmission fluid composition can be from about 100:0 to 0:100, or from about 100:0 to 50:50, or from 100:0 to 60:40. In other embodiments, the one or more ZDDP compounds may have a zinc to phosphorus molar ratio of from about 1.08 to about 1.3, or from about 1.08 to about 1.2, or from about 1.09 to about 1.15. In some embodiments, the one or more one or more ZDDP compounds may be overbased with zinc oxide. In some embodiments, 100 mole percent of the alkyl groups of the one or more one or more ZDDP compounds may be derived from one or more primary alcohol groups.

In some approaches, the one or more ZDDP compounds may be oil soluble salts of dihydrocarbyl dithiophosphoric acids and may be represented by the Formula I:

(Formula I)

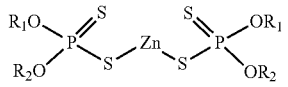

wherein $R_1$ and $R_2$ may be the same or different alkyl groups containing from 1 to 20 carbon atoms, or from about 1 to 18 carbon atoms, or from about 1 to about 16 carbon atoms, or about 2 to about 12 carbon atoms, or about 3 to about 8 carbon atoms, and including moieties such as alkyl, and cycloalkyl moieties. Thus, the moieties may, for example, be ethyl, n-propyl, i-propyl, n-butyl, i-butyl, sec-butyl, amyl, n-hexyl, i-hexyl, 4-methyl-pentyl, n-octyl, decyl, dodecyl, undecyl, dodecyl, tridecyl, tetradecyl, pentadecyl, hexadecyl, heptadecyl, octadecyl, 2-ethylhexyl, nonadecyl, eicosyl, 2-ethylhexyl, cyclohexyl, or methylcyclopentyl.

The average total number of carbon atoms per mole of phosphorus for a ZDDP compound may be calculated by dividing the sum of the carbon atoms in the four alkyl groups $R_1$ and $R_2$ by two. For example, for a single ZDDP compound, if $R_1$ is a $C_3$-alkyl group and $R_2$ is a $C_6$ alkyl group, the total number of carbon atoms is 3+3+6+6=18. Dividing this by two moles of phosphorus per mole of ZDDP gives an average total number of carbon atoms per mole of phosphorus of 9. The average total number of carbon atoms per mole of phosphorus (ATCP) for compositions containing one or more ZDDP compounds may be calculated from the alcohol(s) used to make the ZDDP compounds according to the following formula:

ATCP=2*[(mol % of alc1*# of C atoms in alc1)+(mol % of alc2*# of C atoms in alc2)+(mol % of alc3*# of C atoms in alc3)+ . . . etc.]

wherein alc1, alc2 and alc3 each represent a different alcohol used to make the ZDDP compound(s) and the mol % is the molar percentage of each of the alcohols that was present in the reaction mixture used to make the ZDDP compound(s). The "etc." indicates that if more than three alcohols are used to make the ZDDP compounds(s), the formula can be expanded to include each of the alcohols present in the reaction mixture. The average total number of carbon atoms from both $R_1$ and $R_2$ in the ZDDP is greater than 2 carbon atoms per mole of phosphorus, and in one embodiment is in a range of from greater than 4 to 40 carbon atoms, or from greater than 6 to about 20 carbon atoms, or from greater than 6 to about 16 carbon atoms, or from about 6 to about 15 carbon atoms, or from about 9 to about 15 carbon atoms, or about 12 carbon atoms, per mole of phosphorus.

The zinc dialkyl dithiophosphate compounds may be prepared in accordance with known techniques by first forming a dialkyl dithiophosphoric acid (DDPA), usually by reaction of one or more alcohols and then neutralizing the formed DDPA with a zinc compound. To make the zinc compound, any basic or neutral zinc compound could be used but the oxides, hydroxides, and carbonates are usually employed. The zinc dialkyl dithiophosphates of component (i) may be made by a process such as the process described in U.S. Pat. No. 7,368,596.

The lubricants of the present disclosure can include overbased ZDDP additives that are basic ZDDP additives. The term basic ZDDP additives or equivalent expression, is used herein to describe those zinc salts wherein the metal substituent is present in stoichiometrically greater amounts than the phosphorus acid radical. For instance, normal or neutral zinc phosphorodithioate has two equivalents (i.e., 1 mole) of zinc per two equivalents (i.e., 2 moles) of a phosphorodithioic acid, whereas a basic zinc diorganophosphorodithioate has more than two equivalents of zinc per two equivalents of the phosphorodithioic acid.

In some embodiments, the overbasing can be performed with a basic zinc compound such as zinc oxide. The amount of basic zinc compound required to give the desired overbasing is not critical, rather there be present in the reaction mixture sufficient zinc compound for the overbasing reaction. Although it is not absolutely essential, it has been found that the reaction proceeds in a more satisfactory way if a slight excess of zinc compound over the amount required for reaction is used. This excess should be kept at a minimum level to the necessity for removing large amounts of solid from the final product. In general, any excess of zinc compound should not exceed about 10 to about 15 percent by weight.

Detergents

The TO-4 fluid compositions herein may include one or more neutral, low based, or overbased detergents, or any mixtures thereof and, preferably includes one or more overbased detergents comprising branched polyolefin-substituted metal salts of phenates, sulfonates, calixarates, salixarates, salicylates, carboxylic acids, or combinations thereof. Suitable detergents and their methods of preparation are described in greater detail in numerous patent publications, including U.S. Pat. No. 7,732,390 and references cited therein. For example, the one or more detergents may be an overbased branched calcium sulfonate detergent. As shown in the Examples, linear detergents are not suitable to achieve the required friction performance of the TO-4 standards.

In preferred embodiments or approaches, the one or more metal containing detergents include an overbased metal salt of an branched polyolefin-substituted phenate, sulfonate, and/or salicylate detergent. The branched polyolefin may be derived from a branched alkene having at least 3 carbon atoms, at least 4 carbon atoms (preferably 4 to 100 carbon atoms, 4 to 40 carbon atoms, or 4 to 20 carbons) and wherein the branched polyolefin may have a number average molecular weight of about 100 to about 1,000 (more preferably about 150 to about 800).

In some approaches, examples of branched polyolefin groups suitable for use in the detergents herein include polyolefin groups which are derived from a branched alkene having at least 4 carbon atoms, or up to 12 carbon atoms, or up to 8 carbon atoms, or up to 6 carbon atoms, such as a C4-C6 branched alkene. Suitable branched alkenes include isobutylene (2-methyl propene), 2-methylbutene, 2-ethyl-1-butene, 2-methyl-1-pentene, 3-methyl-1-pentene, 4-methyl-1-pentene, 2-methyl, 3-methyl-1-pentene, 2-ethyl-1-pentene, 3-ethyl-1-pentene, 2-methyl-1-hexene, 3-methyl-1-hexene, 2-ethyl-1-hexene, 3-ethyl-1-hexene, 4-ethyl-1-hexene, 2-methyl-1-heptene, 3-methyl-1-heptene, 2-methyl-1-octene, 2-methyl-1-nonene, 2-methyl-1-decene, 2-methyl-1-undecene, and mixtures thereof. Each polyolefin group may be derived from at least one, at least two or at least three, or at least four, or up to twenty, or up to eighteen, or up to twelve branched alkene monomer units to form a chain with at least two or at least three, or at least four branches from the main chain. In one embodiment, the polyolefin includes a chain derived from at least four, or at least five, or up to eighteen, or up to eight, or up to seven, or up to six branched alkene units. The branched alkene may be branched at the alpha or beta position, or further along the longest chain.

In some approaches, the branched polyolefin of the detergents herein may be a polyolefin of 6 to 50 carbon atoms, or at least 10 carbon atoms, or at least 12 carbon atoms, or at least 14 carbon atoms, or at least 16 carbon atoms, or at least 18 carbon atoms, or at least 20 carbon atoms, or at least 24 carbon atoms, or up to 50 carbons, up to 40 carbon atoms, or up to 35 carbon atoms, or up to 30 carbon atoms. The branched polyolefin group may have a number-average molecular weight Mn of at least 150, or at least 200, or at least 300, or up to 800, or up to 600, or up to 500, or up to 400, or up to 360.

In other approaches, the branched polyolefin may be derived from an isomerized olefin or an isomerized normal alpha olefin having about 4 to about 50 carbons (preferably 6 to 30 carbons) and, in some approaches, an isomerization level of about 0.1 to about 0.4. As understood, a normal alpha olefin refers to olefins which are straight chain, non-branched hydrocarbons with carbon-carbon double bond present in the alpha or primary position of the hydrocarbon chain. An isomerized normal alpha olefin refers to an alpha olefin that has been subjected to isomerization conditions which results in an alteration of the distribution of the olefin species present and/or the introduction of branching along the alkyl chain. The isomerized olefin product may be obtained by isomerizing a linear alpha olefin containing from about 6 to about 40 carbon atoms, or from about 20 to about 28 carbon atoms, or from about 20 to about 24 carbon atoms. In some approaches, the isomerization level of the normal alpha olefin of the branched detergents herein is about 0.10 to about 0.40, or from about 0.10 to about 0.30, or from about 0.12 to about 0.30, or from about 0.22 to about 0.30.

In one approach, the isomerization level can be measured by an NMR method, such as a hydrogen-1 (1H) NMR. In general, the isomerization level represents the relative amount of methyl groups ($CH_3$) (e.g., chemical shift 0.30-1.01 ppm) attached to the methylene backbone groups (—$CH_2$—) (e.g., chemical shift between 1.01-1.38 ppm) and wherein the isomerization level is determined by the formula m/(m+n) where m is NMR integral for methyl groups and n is NMR integral for methylene groups.

In other approaches, the detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or dithiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

In approaches, the overbased metal salt of a branched polyolefin substituted phenate, sulfonate, and/or salicylate detergent has a total base number (TBN) of at least about 250 mg KOH/g on an oil-free basis as measured pursuant to ASTM D2896. In other approaches, an overbased detergent of the transmission fluids herein may have a total base number (TBN) on an oil-free basis of about 200 mg KOH/gram or greater, or as further examples, about 250 mg KOH/gram or greater, or about 350 mg KOH/gram or greater, or about 375 mg KOH/gram or greater, or about 400 mg KOH/gram or greater, as measured by the method of ASTM D-2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or dithiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols. Preferred detergents are branched overbased calcium sulfonate detergents.

For example, the calcium sulfonate detergent may be an overbased branched calcium sulfonate detergent having a total base number (TBN) on an oil-free basis of about 200 mg KOH/g or greater, or about 250 mg KOH/g or greater, or about 300 mg KOH/g or greater, or about 350 mg KOH/g or greater, or about 375 mg KOH/g or greater, or about 400 mg KOH/g or greater, as measured by the method of ASTM D-2896.

The branched detergent, and in particular the branched calcium sulfonate, may be present in an amount to provide about at least about 1,000 ppm of calcium, and in other approaches, about 1,000 ppm to about 5,000 ppm of calcium, or from about 2,250 ppm of calcium to about 4,500 ppm of calcium, or from about 2,500 ppm of calcium to about 4,000 ppm of calcium, or from about 2,750 ppm of calcium to about 3,750 ppm of calcium to the transmission fluid composition, based on the total weight of the transmission fluid composition. In some approaches, the branched calcium sulfonate detergent may have a metal to substrate ratio of from 1.1:1, or from 2:1, or from 4:1, or from 5:1, or from 7:1, or from 10:1, or greater. In other approaches, the branched detergent may be present at about 0.1 wt. % to about 10 wt. %, or about 0.1 wt. % to about 8 wt. %, or about 1 wt. % to about 4 wt. %, or greater than about 4 wt. % to about 8 wt. %.

Base Oil

In one approach, suitable base oils for use in the TO-4 lubricating compositions or gear fluids herein include mineral oils, synthetic oils, and include all common mineral oil basestocks. The mineral oil may be naphthenic or paraffinic. In approaches or embodiments, viscosities of the TO-4 heavy-duty or industrial gear oils herein may range from a KV100 (ASTM 445) of about 5 cSt to about 50 cSt, or about 6 cSt to about 40 cSt, or about 6 cSt to about 30 cSt, or about 6 to about 22 cSt. The mineral oil may be refined by conventional methodology using acid, alkali, and clay or other agents such as aluminium chloride, or may be an extracted oil produced, e.g. by solvent extraction with solvents such as phenol, sulfur dioxide, furfural or dichlorodiethyl ether. The mineral oil may be hydrotreated or hydrofined, dewaxed by chilling or catalytic dewaxing processes, or hydrocracked, such as the Yubase® family of hydrockracked base oils from SK Innovation Co., Ltd. (Seoul, Korea). The mineral oil may be produced from natural crude sources or be composed of isomerized wax materials or residues of other refining processes.

The base oil or base oil of lubricating viscosity used in the compositions herein may be selected from any suitable base oil for driveline or gear oil applications. Examples include the base oils in Groups I-V as specified in the American Petroleum Institute (API) Base Oil Interchangeability Guidelines. These three base oil groups are as follows:

TABLE 1

Base Oil Types

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks and may be preferred for the driveline or gear fluids of the present application. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Suitable oils may be derived from hydrocracking, hydrogenation, hydrofinishing, unrefined, refined, and re-refined oils, and mixtures thereof. In some approaches, the base oil may be a blend of Group I and Group II oils and the blend may be about 0% to about 100% of the Group I oil, about 0% to about 100% of the Group II oil, about 0% to about 100% of the Group III oil, or various blends of Group I and II, Group I and III, or Group II and III oil blends.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

The major amount of base oil included in the gear fluids herein may be selected from the group consisting of Group I, Group II, a Group III, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group I, a Group II, and a combination of two or more of the foregoing, and wherein the major amount of base oil is other than base oils that arise from provision of additive components or viscosity index improvers in the composition.

The base oil may also be any of the synthetic base oils. Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the base oil of lubricating viscosity in the compositions herein may be the balance remaining after subtracting from 100 wt % the sum of the amount of the performance additives. For example, the oil of lubricating viscosity that may be present in a finished fluid may be a "major amount," such as greater than about 50 wt %, greater than about 60 wt %, greater than about 70 wt %, greater than about 80 wt %, greater than about 85 wt %, greater than about 90 wt %, or greater than about 95 wt %.

In some approaches, a preferred base oil or base oil of lubricating viscosity has less than about 25 ppm sulfur, a viscosity index greater than about 120 ppm, and a kinematic viscosity at about 100° C. of about 2 to about 8 cSt. In other approaches, the base oil of lubricating viscosity has less than about 25 ppm sulfur, a viscosity index greater than 120, and a kinematic viscosity at 100° C. of about 4 cSt. The base oil may have CP (paraffinic carbon content) of greater than 40%, greater than 45%, greater than 50%, greater than 55%, or greater than 90%. The base oil may have a CA (aromatic carbon content) of less than 5%, less than 3%, or less than 1%. The base oil may have a CN (naphthenic carbon content) of less than 60%, less than 55%, less than 50%, or less than 50% and greater than 30%. The base oil may have a ratio of 1 ring naphthenes to 2-6 ring naphthenes of less than 2 or less than 1.5 or less than 1.

A suitable driveline, transmission, or gear lubricant composition herein may include additive components in the ranges listed in the following Table 2.

TABLE 2

Suitable and Preferred Driveline or Gear Fluid Compositions

| Component | wt % (Suitable Embodiments) | wt % (Other Embodiments) |
|---|---|---|
| ZDDP | 0.1-5.0 | 1.0-1.5 |
| Branched metal-containing detergent | 0.5-5.0 | 2.0-4.0 |
| Diol/Triol compounds | 0.01-3.5 | 0.01-2.0 |
| Antioxidant(s) | 0.1-5.0 | 0.01-4.0 |
| Detergent(s) | 0.0-15.0 | 1.0-8.0 |
| Corrosion inhibitor(s) | 0.0-5.0 | 0.1-3.0 |

TABLE 2-continued

Suitable and Preferred Driveline or Gear Fluid Compositions

| Component | wt % (Suitable Embodiments) | wt % (Other Embodiments) |
|---|---|---|
| Ash-free phosphorus compound(s) | 0.0-15.0 | 0.1-5.0 |
| Antifoaming agent(s) | 0.0-1.0 | 0.001-0.5 |
| Antiwear agent(s) | 0.0-1.0 | 0.0-0.8 |
| Pour point depressant(s) | 0.0-1.0 | 0.01-0.5 |
| Viscosity index improver(s) | 0.0-20.0 | 0.1-10.0 |
| Dispersants | 0.0-10.0 | 1.0-6.0 |
| Dispersant viscosity index improver(s) | 0.0-10.0 | 0.0-5.0 |
| Friction modifier(s) | 0.0-10.0 | 0.01-4.0 |
| Extreme Pressure Agent | 0.0-1.05 | 0.035-0.35 |
| Base oil(s) | Balance | Balance |
| Total | 100 | 100 |

The percentages of each component above represent the weight percent of each component, based upon the weight of the total final additive or lubricating oil composition. The balance of the lubricating oil composition consists of one or more base oils or solvents. Additives used in formulating the compositions described herein may be blended into the base oil or solvent individually or in various sub-combinations. However, it may be suitable to blend all of the components concurrently using an additive concentrate (i.e., additives plus a diluent, such as a hydrocarbon solvent).

The lubricating composition described herein may be formulated to provide lubrication, enhanced friction performance properties, and improved copper corrosion for various applications. The driveline lubricating compositions herein may be used for lubricating a machine part, such as a gear. Lubricating fluids according to the present disclosure can be used in gear applications, such as industrial gear applications, automotive gear applications, axles, and stationary gearboxes. Gear-types can include, but are not limited to, spur, spiral, worm, rack and pinion, involute, bevel, helical, planetary, and hypoid gears and as well as limited-slip applications and differentials. The driveline lubricating compositions disclosed herein are also suitable for automatic or manual transmissions, including step automatic transmissions, continuously variable transmissions, semi-automatic transmissions, automated manual transmissions, toroidal transmissions, and dual clutch transmissions. The driveline lubricating compositions herein are particularly suited for use in axles, transfer cases, differentials, such as straight differentials, turning differentials, limited-slip differentials, clutch-type differentials, and locking differentials, and the like.

Optional Additives

In other approaches, the lubricant including such additives noted above may also include one or more optional components so long as such components and amounts thereof do not impact the performance characteristics as described in the above paragraphs. These optional components are described in the following paragraphs.

Phosphorus-Containing Compounds

The lubricant composition herein may comprise one or more phosphorus-containing compounds that may impart anti-wear benefits to the fluid. The one or more phosphorus-containing compounds may be present in the lubricating oil composition in an amount ranging from about 0 wt % to about 15 wt %, or about 0.01 wt % to about 10 wt %, or about 0.05 wt % to about 5 wt %, or about 0.1 wt % to about 3 wt % of the lubricating oil composition. The phosphorus-containing compound may provide up to 5000 ppm phosphorus, or from about 50 to about 5000 ppm phosphorus, or from about 300 to about 1500 ppm phosphorus, or up to 600 ppm phosphorus, or up to 900 ppm phosphorus to the lubricant composition.

The one or more phosphorus-containing compounds may include ashless phosphorus-containing compounds. Examples of suitable phosphorus-containing compound include, but are not limited to, thiophosphates, dithiophosphates, phosphates, phosphoric acid esters, phosphate esters, phosphites, phosphonates, phosphorus-containing carboxylic esters, ethers, or amides salts thereof, and mixtures thereof. Phosphorus containing anti-wear agents are more fully described in European Patent 0612839.

It should be noted that often the term phosphonate and phosphite are used often interchangeably in the lubricant industry. For example, dibutyl hydrogen phosphonate is often referred to as dibutyl hydrogen phosphite. It is within the scope of the present invention for the inventive lubricant composition to include a phosphorus-containing compound that may be referred to as either a phosphite or a phosphonate.

In any of the above described phosphorus-containing compounds, the compound may have about 5 to about 20 weight percent phosphorus, or about 5 to about 15 weight percent phosphorus, or about 8 to about 16 weight percent phosphorus, or about 6 to about 9 weight percent phosphorus.

The inclusion of the phosphorus-containing compound in combination with the above described dispersant to a lubricant compositions unexpectedly imparts positive frictional characteristics, such as a low friction coefficient, to the lubricant composition. The inventive effect is even further pronounced in some cases where the phosphorus-containing compound, on its own, imparts negative frictional characteristics to the fluid. When these relatively poor friction reducing phosphorus-containing compounds are combined with the olefin copolymer dispersant described herein, the lubricant composition has an improved, i.e., lower, friction coefficient. That is, the dispersants herein tend to transform fluids containing phosphorus-containing compounds having relatively poor friction coefficients into fluids with improved frictional properties.

This improvement in frictional properties of the lubricating compositions including the phosphorus-containing compounds and the olefin copolymer dispersant described herein is surprising because the frictional properties of the fluid are better than combinations of the phosphorus-containing compounds in combination with other types of dispersants, including polyisobutylene succinimide dispersants and olefin copolymer succinimide dispersants that do not have the specified characteristics of the copolymers described above.

Another type of phosphorus-containing compound that when combined with the olefin copolymer dispersant herein imparts improved frictional characteristics to a lubricating composition is an ashless (metal free) phosphorus-containing compound.

In some embodiments, the ashless phosphorus-containing compound may be dialkyl dithiophosphate ester, amyl acid phosphate, diamyl acid phosphate, dibutyl hydrogen phosphonate, dimethyl octadecyl phosphonate, salts thereof, and mixtures thereof.

The ashless phosphorus-containing compound may be have the formula:

(Formula XIV)

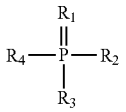

wherein R1 is S or O; R2 is —OR, —OH, or —R"; R3 is —OR", —OH, or SR'"C(O)OH; R4 is —OR"; R'" is C1 to C3 branched or linear alkyl chain; and R" is a C1 to C18 hydrocarbyl chain. When the phosphorous-containing compound has the structure shown in Formula XIV, the compound may have about 8 to about 16 weight percent phosphorus.

In some embodiments the lubricant composition comprises a phosphorus-containing compound of Formula XIV wherein R1 is S; R2 is —OR"; R3 is S R""COOH; R4 is —OR"; R'" is C3 branched alkyl chain; R" is C4; and wherein the phosphorus-containing compound is present in an amount to deliver between 80-900 ppm phosphorus to the lubricant composition.

In another embodiment, the lubricant composition comprises a phosphorus-containing compound of Formula XIV wherein R1 is O; R2 is —OH; R3 is —OR" or —OH; R4 is —OR"; R" is C5; and wherein phosphorus-containing compound is present in an amount to deliver between 80-1500 ppm phosphorus to the lubricant composition.

In yet another embodiment, the lubricant composition comprises a phosphorus-containing compound of Formula XIV wherein R1 is O; R2 is OR"; R3 is H; R4 is —OR"; R" is C4; and wherein the one or more phosphorus-containing compound(s) is present in an amount to deliver between 80-1550 ppm phosphorus to the lubricant composition.

In other embodiments, the lubricant composition comprises a phosphorus-containing compound of Formula XIV wherein R1 is O; R2 is —R"; R3 is —OCH3 or —OH; R4 is —OCH3; R" is C18; and wherein the one or more phosphorus-containing compound(s) is present in an amount to deliver between 80-850 ppm phosphorus to the lubricant composition.

In some embodiments, the phosphorus-containing compound has the structure shown in Formula XIV and delivers about 80 to about 4500 ppm phosphorus to the lubricant composition. In other embodiments, the phosphorus-containing compound is present in an amount to deliver between about 150 and about 1500 ppm phosphorus, or between about 300 and about 900 ppm phosphorus, or between about 800 to 1600 ppm phosphorus, or about 900 to about 1800 ppm phosphorus, to the lubricant composition.

Anti-Wear Agents

The lubricant composition may also include other antiwear agents that are non-phosphorus-containing compounds. Examples of such antiwear agents include borate esters, borate epoxides, thiocarbamate compounds (including thiocarbamate esters, alkylene-coupled thiocarbamates, and bis(S-alkyldithiocarbamyl)disulfides, thiocarbamate amides, thiocarbamic ethers, alkylene-coupled thiocarbamates, and bis(S-alkyldithiocarbamyl) disulfides, and mixtures thereof), sulfurized olefins, tridecyl adipate, titanium compounds, and long chain derivatives of hydroxyl carboxylic acids, such as tartrate derivatives, tartramides, tartrimides, citrates, and mixtures thereof. A suitable thiocarbamate compound is molybdenum dithiocarbamate. Suitable tartrate derivatives or tartrimides may contain alkyl-ester groups, where the sum of carbon atoms on the alkyl groups may be at least 8. The tartrate derivative or tartrimide may contain alkyl-ester groups, where the sum of carbon atoms on the alkyl groups may be at least 8. The antiwear agent may in one embodiment include a citrate. The additional anti-wear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Extreme Pressure Agents

The lubricant compositions of the disclosure may also contain other extreme pressure agent(s) so long as the lubricating compositions herein include the noted amounts and profiles set forth herein. The optional extreme pressure agent may contain sulfur and may contain at least 12 percent by weight sulfur. In some embodiments, the extreme pressure agent added to the lubricating oil is sufficient to provide at least 350 ppm sulfur, 500 ppm sulfur, 760 ppm sulfur, from about 350 to about 2,000 ppm sulfur, from about 2,000 to about 30,000 ppm sulfur, or from about 2,000 to about 4,800 ppm sulfur, or about 4,000 to about 25,000 ppm sulfur to the lubricant composition.

A wide variety of sulfur-containing extreme pressure agents are suitable and include sulfurized animal or vegetable fats or oils, sulfurized animal or vegetable fatty acid esters, fully or partially esterified esters of trivalent or pentavalent acids of phosphorus, sulfurized olefins (see, for example U.S. Pat. Nos. 2,995,569; 3,673,090; 3,703,504; 3,703,505; 3,796,661; 3,873,454 4,119,549; 4,119,550; 4,147,640; 4,191,659; 4,240,958; 4,344,854; 4,472,306; and 4,711,736), dihydrocarbyl polysulfides (see for example U.S. Pat. Nos. 2,237,625; 2,237,627; 2,527,948; 2,695,316; 3,022,351; 3,308,166; 3,392,201; 4,564,709; and British 1,162,334), functionally-substituted dihydrocarbyl polysulfides (see for example U.S. Pat. No. 4,218,332), and polysulfide olefin products (see for example U.S. Pat. No. 4,795,576). Other suitable examples include organo-sulfur compounds selected from sulfurized olefins, sulfur-containing amino heterocyclic compounds, 5-dimercapto-1,3,4-thiadiazole, polysulfides having a majority of S3 and S4 sulfides, sulfurized fatty acids, sulfurized branched olefins, organic polysulfides, and mixtures thereof.

In some embodiments the extreme pressure agent is present in the lubricating composition in an amount of up to about 3.0 wt % or up to about 5.0 wt %. In other embodiments, the extreme pressure agent is present from about 0.05 wt % to about 0.5 wt %, based on the total lubricant composition. In other embodiments, the extreme pressure agent is present from about 0.1 wt % to about 3.0 wt %, based on the total lubricant composition. In other embodiments the extreme pressure agent is present in an amount between about 0.6 wt % and about 1 wt %, based on the total lubricant composition. In yet other embodiments, the detergent is present in an amount of about 1.0 wt %, based on the total lubricant composition.

One suitable class of extreme pressure agents are polysulfides composed of one or more compounds represented by the formula: Ra-Sx-Rb where Ra and Rb are hydrocarbyl groups each of which may contain 1 to 18, and in other approaches, 3 to 18 carbon atoms and x is may be in the range of from 2 to 8, and typically in the range of from 2 to 5, especially 3. In some approaches, x is an integer from 3 to 5 with about 30 to about 60 percent of x being an integer of 3 or 4. The hydrocarbyl groups can be of widely varying types such as alkyl, cycloalkyl, alkenyl, aryl, or aralkyl. Tertiary alkyl polysulfides such as di-tert-butyl trisulfide, and mixtures comprising di-tert-butyl trisulfide (e.g., a mixture composed principally or entirely of the tri, tetra-, and pentasulfides) may be used. Examples of other useful dihydrocarbyl polysulfides include the diamyl polysulfides, the dinonyl polysulfides, the didodecyl polysulfides, and the dibenzyl polysulfides.

Another suitable class of extreme pressure agent is sulfurized isobutenes made by reacting an olefin, such as isobutene, with sulfur. Sulfurized isobutene (SIB), notably sulfurized polyisobutylene, typically has a sulfur content of from about 10 to about 55%, desirably from about 30 to about 50% by weight. A wide variety of other olefins or unsaturated hydrocarbons, e.g., isobutene dimer or trimer, may be used to form the sulfurized olefin extreme pressure agents. Various methods have been disclosed in the prior art for the preparation of sulfurized olefins. See, for example, U.S. Pat. No. 3,471,404 to Myers; U.S. Pat. No. 4,204,969 to Papay et al.; U.S. Pat. No. 4,954,274 to Zaweski et al.; U.S. Pat. No. 4,966,720 to DeGonia et al.; and U.S. Pat. No. 3,703,504 to Horodysky, et al, each of which his incorporated herein by reference.

Methods for preparing sulfurized olefins, including the methods disclosed in the aforementioned patents, generally involve formation of a material, typically referred to as an adduct", in which an olefin is reacted with a sulfur halide, for example, sulfur monochloride. The adduct is then reacted with a sulfur source to provide the sulfurized olefin. The quality of a sulfurized olefin is generally measured by various physical properties, including, for example, viscosity, sulfur content, halogen content and copper corrosion test weight loss. U.S. Pat. No. 4,966,720, relates to sulfurized olefins useful as extreme pressure additives in lubrication oils and to a two stage reaction for their preparation.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox® L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox® 4716 available from Albemarle Corporation.

Useful antioxidants may include diarylamines and phenols. In an embodiment, the lubricating oil composition may contain a mixture of a diarylamine and a phenol, such that each antioxidant may be present in an amount sufficient to provide up to about 5 wt %, based on the weight of the lubricant composition. In an embodiment, the antioxidant may be a mixture of about 0.3 wt % to about 1.5 wt % diarylamine and about 0.4 wt % to about 2.5 wt % phenol, based on the lubricant composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges about 0 wt % to about 20 wt %, or about 0.1 wt % to about 10 wt %, or about 1 wt % to about 5 wt %, of the lubricating oil composition.

Dispersants

Dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,634,515, 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

In some embodiments, the additional dispersant may be derived from a polyalphaolefin (PAO) succinic anhydride, an olefin maleic anhydride copolymer. As an example, the additional dispersant may be described as a poly-PIBSA. In another embodiment, the additional dispersant may be derived from an anhydride which is grafted to an ethylene-propylene copolymer. Another additional dispersant may be a high molecular weight ester or half ester amide.

Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or U.S. Pat. No. 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylene-polyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321. The percent conversion of the polyolefin is calculated from the % actives using the equation in column 5 and 6 in U.S. Pat. No. 5,334,321.

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may also be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may also be high molecular weight esters or half ester amides. A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603 and 4,666,460); Cyclic carbonate or thiocarbonate, linear monocarbonate or polycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711). The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

In yet other embodiments, the optional dispersant additive may be a hydrocarbyl substituted succinamide or succinimide dispersant. In approaches, the hydrocarbyl substituted succinamide or succinimide dispersant may be derived from a hydrocarbyl substituted acylating agent reacted with a polyalkylene polyamine and wherein the hydrocarbyl substituent of the succinamide or the succinimide dispersant is a linear or branched hydrocarbyl group having a number average molecular weight of about 250 to about 5,000 as measured by GPC using polystyrene as a calibration reference.

In some approaches, the polyalkylene polyamine used to form the dispersant has the Formula

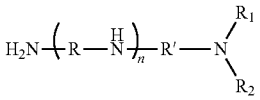

wherein each R and R', independently, is a divalent C1 to C6 alkylene linker, each $R_1$ and $R_2$, independently, is hydrogen, a C1 to C6 alkyl group, or together with the nitrogen atom to which they are attached form a 5- or 6-membered ring optionally fused with one or more aromatic or non-aromatic rings, and n is an integer from 0 to 8. In other approaches, the polyalkylene polyamine is selected from the group consisting of a mixture of polyethylene polyamines having an average of 5 to 7 nitrogen atoms, triethylenetetramine, tetraethylenepentamine, and combinations thereof.

The dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, about 0.1 to 8 wt %, or about 1 wt % to about 10 wt %, or about 1 wt % to about 8 wt %, or about 1 wt % to about 6 wt %, based upon the final weight of the lubricating oil composition. In some embodiments, the lubricating oil composition utilizes a mixed dispersant system. A single type or a mixture of two or more types of dispersants in any desired ratio may be used.

The dispersant, if present, can be used in an amount sufficient to provide up to about 10 wt %, based upon the final weight of the lubricating oil composition. Another amount of the dispersant that can be used may be about 0.1 wt % to about 10 wt %, or about 0.1 wt % to about 10 wt %, or about 3 wt % to about 8 wt %, or about 1 wt % to about 6 wt %, based upon the final weight of the lubricating oil composition.

Viscosity Index Improvers

The lubricant compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1, which is incorporated herein by reference.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, about 3 wt % to about 20 wt %, about 3 wt % to about 15 wt %, about 5 wt % to about 15 wt %, or about 5 wt % to about 10 wt %, of the lubricating oil composition.

In some embodiments, the viscosity index improver is a polyolefin or olefin copolymer having a number average molecular weight of about 10,000 to about 500,000, about 50,000 to about 200,000, or about 50,000 to about 150,000. In some embodiments, the viscosity index improver is a hydrogenated styrene/butadiene copolymer having a number average molecular weight of about 40,000 to about 500,000, about 50,000 to about 200,000, or about 50,000 to about 150,000. In some embodiments, the viscosity index improver is a polymethacrylate having a number average molecular weight of about 10,000 to about 500,000, about 50,000 to about 200,000, or about 50,000 to about 150,000.

Other Optional Additives

Other additives may be selected to perform one or more functions required of lubricant composition. Further, one or more of the mentioned additives may be multi-functional and provide functions in addition to or other than the function prescribed herein. The other additives may be in addition to specified additives of the present disclosure and/or may comprise one or more of metal deactivators, viscosity index improvers, ashless TBN boosters, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in optional amount sufficient to provide about 0 wt % to about 5 wt %, about 0.01 wt % to about 3 wt %, about 0.1 wt % to about 2 wt %, based upon the final weight of the lubricating oil composition.

The lubricant composition may also include corrosion inhibitors (it should be noted that some of the other mentioned components may also have copper corrosion inhibition properties). Suitable inhibitors of copper corrosion include ether amines, polyethoxylated compounds such as ethoxylated amines and ethoxylated alcohols, imidazolines, monoalkyl and dialkyl thiadiazole, and the like.

Thiazoles, triazoles and thiadiazoles may also be used in the lubricants. Examples include benzotriazole, tolyltriazole, octyltriazole, decyltriazole; dodecyltriazole, 2-mercaptobenzothiazole, 2,5-dimercapto-1,3,4-thiadiazole, 2-mercapto-5-hydrocarbylthio-1,3,4-thiadiazoles, and 2-mercapto-5-hydrocarbyldithio-1,3,4-thiadiazoles. In one embodiment, the lubricant composition includes a 1,3,4-thiadiazole, such as 2-hydrocarbyldithio-5-mercapto-1,3,4-dithiadiazole.

Anti-foam/Surfactant agents may also be included in a fluid according to the present invention. Various agents are known for such use. Copolymers of ethyl acrylate and hexyl ethyl acrylate, such as PC-1244, available from Solutia may be used. In other embodiments, silicone fluids, such as 4% DCF may be included. Mixtures of anti-foam agents may also be present in the lubricant composition.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Example 1

TO-4 lubricants of Table 3 below were evaluated for low speed wear pursuant to ASTM D4998 and for load stage scuffing pursuant to CEC L-07 (A/8.3/90 referring to gear type A, peripheral speeds of 8.3 m/s, and an oil sump temperature of 90 C). Passing low speed wear performance is 100 mg or less, and preferably 50 mg or less wear. Passing scuffing is a achieving a passing load stage (LS) of 9 or higher, preferably 10 or higher, more preferably 11 or higher, or most preferably 12. A reported passing load stage herein means such load stage is the highest achievable passing load stage with such fluid (meaning, e.g., the next higher load stage was a failure).

The lubricants for this evaluation included a branched calcium sulfonate detergent having a TBN of 300 providing the levels of fluid calcium set forth in Table 3. The lubricants also included a zinc dialkyl dithiophosphate (ZDDP) providing the levels of zinc also set forth in Table 3. All evaluated lubricants also included the same base additive package including an antioxidant, a corrosion inhibitor, and an antifoam in an API Group I base oil to achieve a fluid having a KV100 of about 6 to about 6.5 cSt (ASTM D445). The lubricants also included the noted levels of glycerol of Table 3. Test results are provided in Table 4 below.

TABLE 3

TO-4 Style Lubricants

| | Ca, ppm (from detergent) | Zinc, ppm (from ZDDP) | Glycerol (wt %) |
|---|---|---|---|
| Comparison 1 | 3600 | 1000 | 0 |
| Inventive 1 | 3600 | 1000 | 0.0125 |
| Inventive 2 | 3600 | 1000 | 0.025 |
| Inventive 3 | 3600 | 1000 | 0.03 |
| Inventive 4 | 3200 | 850 | 0.03 |
| Inventive 5 | 3600 | 1000 | 0.05 |
| Inventive 6 | 3600 | 1000 | 2 |
| Comparison 2 | 3600 | 1000 | 4 |

TABLE 4

Results

| | ASTM D4998 FZG Wear | CEC L-07 FZG A/8.3/90 | Performance |
|---|---|---|---|
| Comparison 1 | 146, 242, 248 | Pass LS 12 | FAIL |
| Inventive 1 | 15 | Expected to pass LS 11-12 | PASS |
| Inventive 2 | 32 | Expected to pass LS 11-12 | PASS |
| Inventive 3 | 4 | Expected to pass LS 11-12 | PASS |
| Inventive 4 | 15 | Pass LS 11 | PASS |
| Inventive 5 | 6 | Expected to pass LS 11-12 | PASS |
| Inventive 6 | 25 | Pass LS 11 | PASS |
| Comparison 2 | 32 | Pass LS 8 | FAIL |

As shown in Table 4, while comparison 1 achieved a high passing load stage of 12, this fluid had unacceptable low speed wear. On the other hand, comparison 2 had good low speed wear, but this fluid could not achieve a high enough load stage and was also a failure. Only Inventive lubricants 1 to 6 that included about 0.01 to about 2 weight percent of glycerol achieved both passing low speed wear and acceptable passing load stages in the FZG testing. While comparison 2 included glycerol, this comparative fluid also included too much glycerol and, while maintaining low wear values in the ASTM D4998 performance, the extreme pressure load stage of this lubricant was too low for a passing fluid.

Example 2

A comparative TO-4 lubricant including the composition of Example 1 except using a linear 300 TBN calcium detergent providing 3600 ppm of calcium is to be compared with the inventive TO-4 lubricants of Example 1 including the branched 300 TBN calcium detergents. The comparative lubricants with the linear detergent additives are expected to fail TO-4 friction performance, such the VC70 Friction, sequence 1222 test. On the other hand, the inventive lubricants of Example 1 with the branched detergent additives pass the VC70 Friction, sequence 1222 testing.

It is noted that, as used in this specification and the appended claims, the singular forms a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. An off-road lubricant composition comprising:

one or more base oils of lubricating viscosity;

about 600 ppm to about 1,500 ppm of zinc provided by a zinc dialkyl dithiophosphate compound;

one or more metal-containing detergents providing about 2,750 ppm to about 4,000 ppm of metal selected from calcium, magnesium and/or sodium and provided from one or more C6 to C30 branched metal salts of phenates, sulfonates, calixarates, salixarates, salicylates, carboxylic acids, or combinations thereof;

no more than about 300 ppm of nitrogen provided from one or more nitrogen-containing ashless dispersants;

about 0.01 to about 2.0 weight percent of a non-esterified C2 to C3 diol or triol compound or mixture thereof, wherein the non-esterified C2 to C3 diol or triol compound is trihydroxypropane; and wherein the off-road lubricant composition has less than 0.1 weight percent of glycerol monooleate.

2. The off-road lubricant composition of claim 1, wherein the one or more metal containing detergents include an overbased metal salt of a branched polyolefin substituted phenate, sulfonate, and/or salicylate detergent.

3. The off-road lubricant composition of claim 2, wherein the branched polyolefin is derived from a branched alkene having at least 4 carbon atoms and wherein the branched polyolefin has a number average molecular weight of about 100 to about 800.

4. The off-road lubricant composition of claim 2, wherein the branched polyolefin is derived from an isomerized normal alpha olefin having about 6 to about 30 carbons and an isomerization level of about 0.1 to about 0.4.

5. The off-road lubricant composition of claim 2, wherein the overbased metal salt of a branched polyolefin substituted phenate, sulfonate, and/or salicylate detergent has a total base number (TBN) of at least about 250 mg KOH/g on an oil-free basis as measured pursuant to ASTM D2896.

6. The off-road lubricant composition of claim 2, wherein the one or more overbased detergents is a branched calcium sulfonate.

7. The off-road lubricant composition of claim 1, wherein the off-road lubricant composition satisfies the requirements of Caterpillar TO-4 low speed wear and scuffing tests with no more than 100 mg of wear as measured pursuant to ASTM D4998 and a passing load stage of 9 or higher pursuant to CEC L-07 (FZG A/8.3/90).

8. The off-road lubricant composition of claim 1, wherein the nitrogen-containing ashless dispersant is a succinimide dispersant.

9. A method for providing low speed wear and scuffing protection to gears, bearings, and/or clutches according to Caterpillar TO-4 requirements as measured pursuant to ASTM D4998 and CEC L-07 (FZG A/8.3/90), the method comprising:

lubricating the gears, bearings, and/or clutches with a lubricating composition;

wherein the lubricating composition includes one or more base oils of lubricating viscosity;

about 600 ppm to about 1,500 ppm of zinc provided by a zinc dialkyl dithiophosphate compound;

one or more metal-containing detergents providing about 2750 ppm to about 4000 ppm of metal selected from calcium, magnesium and/or sodium and provided from one or more C6 to C30 branched metal salts of phenates, sulfonates, calixarates, salixarates, salicylates, carboxylic acids, or combinations thereof;

no more than about 300 ppm of nitrogen provided from one or more nitrogen-containing ashless dispersants;

about 0.01 to about 2.0 weight percent of a non-esterified C2 to C3 diol or triol compound or mixture thereof, and wherein the non-esterified C2 to C3 diol or triol compound is trihydroxypropane; and wherein the lubricating composition has less than 0.1 weight percent of glycerol monooleate.

10. The method of claim 9, wherein the one or more metal containing detergents include an overbased metal salt of a branched polyolefin substituted phenate, sulfonate, and/or salicylate detergent.

11. The method of claim 10, wherein the branched polyolefin is derived from a branched alkene having at least 4 carbon atoms and wherein the branched polyolefin has a number average molecular weight of about 100 to about 800.

12. The method of claim 10, wherein the branched polyolefin is derived from an isomerized normal alpha olefin having about 4 to about 100 carbons and an isomerization level of about 0.1 to about 0.4.

13. The method of claim 10, wherein the overbased metal salt of a branched polyolefin substituted phenate, sulfonate, and/or salicylate detergent has a total base number (TBN) of at least about 250 mg KOH/g on an oil-free basis as measured pursuant to ASTM D2896.

14. The method of claim 13, wherein the one or more overbased detergents is a branched calcium sulfonate.

15. The method of claim 9, wherein the lubricating composition exhibits no more than 50 mg of wear as measured pursuant to ASTM D4998 and a passing load stage of 9 or higher pursuant to CEC L-07 (FZG A/8.3/90).

16. The method of claim 9, wherein the nitrogen-containing ashless dispersant is a succinimide dispersant.

17. The lubricant of claim 1, wherein the off-road lubricant composition has less than 0.05 weight percent of glycerol monooleate.

18. The lubricant of claim 1, wherein the off-road lubricant composition is free of other friction modifiers.

19. The method of claim 9, wherein the lubricating composition has less than 0.05 weight percent of glycerol monooleate.

20. The method of claim 9, wherein the lubricating composition is free of other friction modifiers.

* * * * *